United States Patent [19]

Unger

[11] 4,054,354

[45] Oct. 18, 1977

[54] CONNECTOR HOUSING

[75] Inventor: William Lewis Unger, Stewartstown, Pa.

[73] Assignee: E. I. Du Pont de Nemours and Company, Wilmington, Del.

[21] Appl. No.: 618,370

[22] Filed: Oct. 1, 1975

[51] Int. Cl.[2] ..... H01R 13/50

[52] U.S. Cl. ..... 339/205; 29/629; 29/423; 174/72 A; 339/218 M; 339/276 SF; 339/119 R

[58] Field of Search ..... 339/119, 147, 157, 198, 339/205, 218, 256 SP, 258 S, 276 SF; 29/629, 423; 113/119; 174/72 A; 206/330

[56] References Cited

U.S. PATENT DOCUMENTS

| | | | |
|---|---|---|---|
| 1,514,618 | 11/1924 | Ide | 206/330 |
| 2,701,867 | 2/1955 | Obenschain et al. | 339/218 M |
| 2,965,872 | 12/1960 | Linn | 339/198 N |
| 3,086,251 | 4/1963 | Bernat | 339/218 M |
| 3,152,219 | 10/1964 | Murray et al. | 339/198 R |
| 3,500,295 | 3/1970 | Faber et al. | 339/218 M |
| 3,753,216 | 8/1973 | Johnson et al. | 339/218 R |

*Primary Examiner*—Joseph H. McGlynn

[57] ABSTRACT

A connector housing includes an electrical terminal attached to a carrier strip and an integrally-molded insulation housing over the terminal and carrier strip.

2 Claims, 2 Drawing Figures

CONNECTOR HOUSING

BACKGROUND OF THE INVENTION

1. Field of the Invention

The present invention relates to electrical connectors and terminals and a method of assembling such connectors, and particularly relates to common point electrical connectors for terminating at least three wires at a common point and a method of assembling such connectors.

2. Description of the Prior Art

Electrical connectors including housings and terminals for commonly terminating three or more wires are well known in the prior art. Such connectors have generally been manufactured by molding an insulated housing having a central solid portion with a slot for receiving the electrical terminal and a rectangular cavity at each end of the central portion. The electrical terminal has generally been assembled in the individual housing by manual or machine insertion requiring individual handling or assembly equipment for inserting the terminal into the housing. Whether the terminal is inserted in the housing manually or by machine, the assembly cost has always contributed substantially to the finished cost of such connectors. Additionally, the electrical connectors so produced have been shipped as loose pieces requiring manual packaging or separate packaging equipment. Shipment in loose piece form has frequently resulted in breakage of the connector housing or disengagement of the terminal from the housing.

The present invention provides a solution to all of the above problems of the prior art method of assembling such connectors by providing for assembly of the electrical terminals on a carrier strip and integrally molding the housing over the terminal and carrier strip. Shipment of such electrical connectors on reels minimizes breakage, and integrally molding the terminals in the housings eliminates the possibility of the terminals from being disengaged from the slot and separated from the housing.

SUMMARY OF THE INVENTION

According to the present invention, an electrical connector is provided comprising a carrier strip, an electrical terminal attached to the carrier strip and an insulated housing integrally molded over the terminal and carrier strip.

Also provided is a method of assembling an electrical connector including the steps of attaching an electrical terminal to a carrier strip and integrally molding an insulation housing over the terminal and carrier strip.

The electrical connectors, and the method of assembling them, of the present invention substantially reduces the cost of assembling and packaging such connectors. A plurality of the connectors molded on a carrier strip may be reeled for shipment, and the integral molding of the housing over the terminal and carrier eliminates the possibility of the terminal being disengaged and separated from the housing.

DESCRIPTION OF THE PREFERRED EMBODIMENTS

Figures 1, 2, 3:
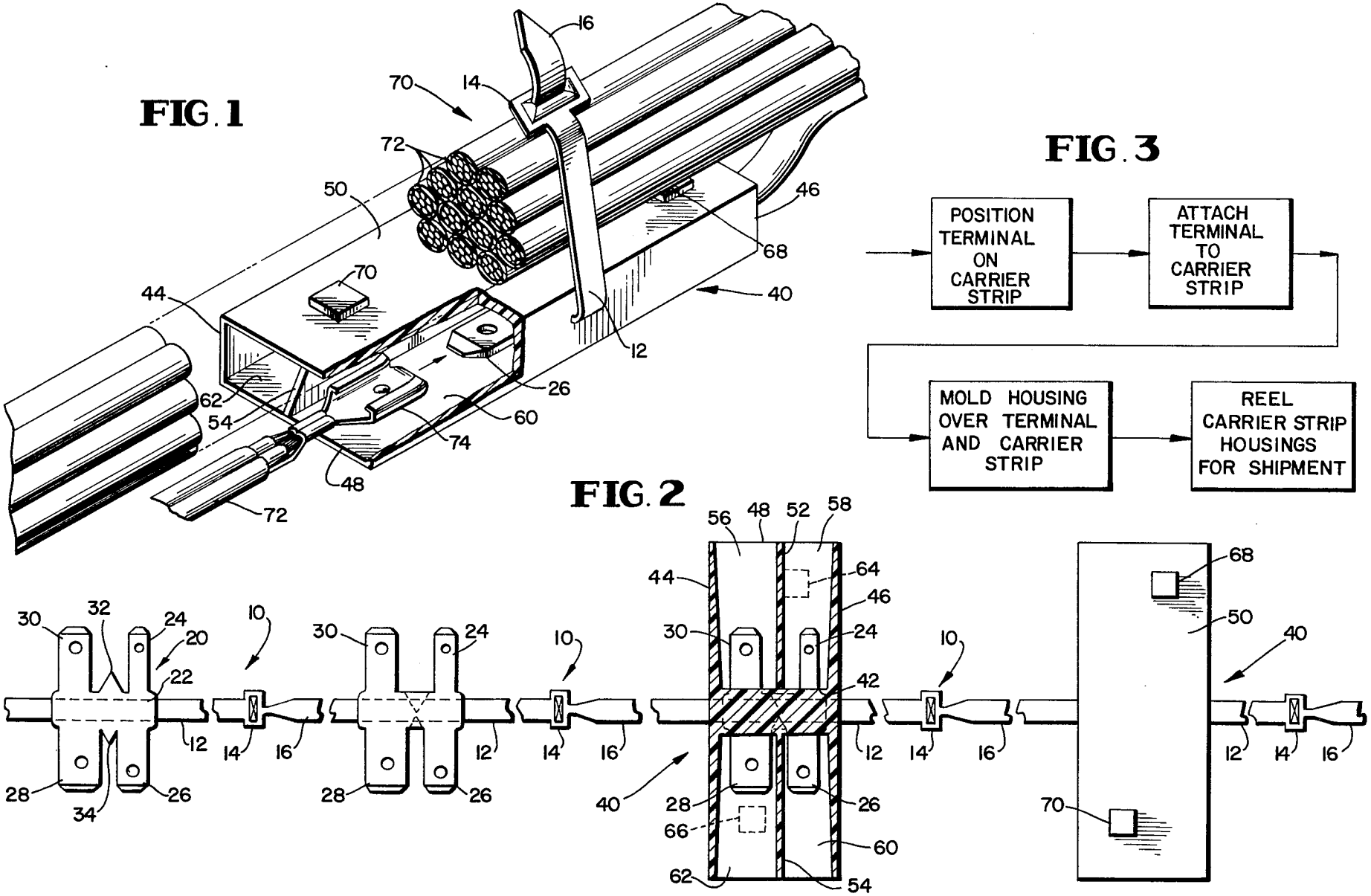
FIG. 1 is a perspective view in partial section of an embodiment of an electrical connector of the present invention.
FIG. 2 is a plan view illustrating the steps of assembling an electrical connector, according to the present invention.
FIG. 3 is a flow diagram embodying the steps of the method of the invention.

An electrical connector and method of assembly, according to the present invention, is described below with reference to the attached drawings, wherein the same elements are identified by the same numerals throughout the various views.

A continuous carrier strip 10 is provided in the form of a plurality of wire ties 12. Each wire tie 12 has a buckle 14 and a tail 16 integrally formed therein.

An electrical terminal 20 comprises a common bus 22 and four male spade-type terminals 24, 26, 28 and 30 extending from the bus, and a triangular staking tab 32, 34 extends from each of the common bus 22. The terminal 20 is positioned on the carrier strip 10 and attached thereto by folding each tab 32, 34 back to clinch the carrier strip 10.

A housing 40 is integrally molded over the carrier strip 10 and the terminal 20 attached thereto by the clinched tabs 32, 34. Housing 40 comprises a central insulating block 42 molded around the carrier strip 10 and bus 22, side walls 44, 46 and top and bottom walls 48, 50 and interior central walls 52, 54 which provide separate cavities 56, 58, 60 and 62 for each spade-type terminal 24, 26, 28 and 30. Stacking recesses 64, 66 are provided in the exterior of bottom wall 48 and stacking blocks 68, 70 are provided on the exterior side of top wall 50. The cooperating stacking recesses 64, 66 and blocks 66, 68 provide for stacking a number of the connector housings 40.

The carrier strip 10 may be a plurality of wire ties 12, as illustrated, or simply a plain strip of flat, flexible, continuous material, e.g. polyester or polyimide film. The carrier strip may be fed from reels in a conventional manner to an assembly station for attachment of the terminals 20 and either re-reeled or fed directly to a suitable molding apparatus by conventional strip feeding means. On emergence from the molding apparatus, the connector may be reeled for shipment; or, the carrier strip may be severed and the connector shipped in loose-piece form.

In the embodiment illutrated in FIG. 1, the wire ties 12 integrally molded in the housing 40 are wrapped around a bundle 70 of wires 72 and the tail 16 is inserted and locked in the buckle 14 to secure the connector to the cable bundle.

A spade disconnect terminal 74, crimped on a wire 72, may then be inserted on each male spade-type terminal to provide a common electrical connection for a plurality of wires.

What is claimed is

1. An electrical connector including a housing, a terminal and a carrier strip, said terminal attached to said carrier strip, said housing being integrally molded and surrounding said carrier strip and said terminal, said carrier strip being a wire tie.

2. A connector, as recited in claim 1, said terminal comprising a common bus having at least three spade-type terminals extending therefrom.

* * * * *